US005466160A

United States Patent [19]

Ogura

[11] Patent Number: 5,466,160

[45] Date of Patent: Nov. 14, 1995

[54] SURFACE MOUNT TYPE RECEPTACLE OF COAXIAL CONNECTOR AND MOUNTING ARRANGEMENT FOR MOUNTING RECEPTACLE OF COAXIAL CONNECTOR ON SUBSTRATE

[75] Inventor: Hiromi Ogura, Ishikawa, Japan

[73] Assignee: Murata Mfg. Co., Ltd., Japan

[21] Appl. No.: 335,043

[22] Filed: Nov. 7, 1994

[30] Foreign Application Priority Data

Nov. 8, 1993 [JP] Japan ..... 5-303460

[51] Int. Cl.[6] ..... H01R 9/09

[52] U.S. Cl. ..... 439/63; 439/581

[58] Field of Search ..... 439/581, 63, 83

[56] References Cited

U.S. PATENT DOCUMENTS

| | | | |
|---|---|---|---|
| 4,642,591 | 2/1987 | Kobayashi | 333/227 |
| 5,078,621 | 1/1992 | Nishikawa et al. | 439/581 |
| 5,180,315 | 1/1993 | Nagashima | 439/581 |
| 5,190,474 | 3/1993 | Ginet | 439/581 |
| 5,322,453 | 6/1994 | Resnick et al. | 439/63 |
| 5,336,112 | 8/1994 | Michishita et al. | 439/581 |

FOREIGN PATENT DOCUMENTS

| | | | |
|---|---|---|---|
| 0419938 | 3/1991 | European Pat. Off. | 439/63 |
| 63-313901 | 12/1988 | Japan . | |
| 1-77008 | 5/1989 | Japan . | |
| 4-339401 | 11/1992 | Japan . | |

*Primary Examiner*—Daniel W. Howell
*Assistant Examiner*—Jill DeMello
*Attorney, Agent, or Firm*—Ostrolenk, Faber, Gerb & Soffen

[57] ABSTRACT

A surface mount type receptacle of a coaxial connector is provided which is mounted on a substrate having a hot-line pattern conductor and a top earth pattern conductor formed on a top surface thereof, and a bottom earth pattern conductor formed on a bottom surface thereof. A dielectric case of the receptacle has a concavity formed to extend from the top surface thereof toward the center thereof. In the concavity, inner and outer conductors are arranged. At least one hot-line terminal is formed in the case to be electrically connected to the inner conductor and extend from the inner conductor through the side surface of the case to the bottom surface thereof, and an earth terminal is formed in the case to be electrically connected to the outer conductor and extend from the outer conductor to the bottom surface thereof, the earth terminal having a main portion thereof provided in the case to oppose to the bottom surface of the case. The earth terminal is formed between the main portion of the hot-line terminal and the top surface of the substrate to decrease an area where the hot-line terminal opposes to the bottom earth pattern conductor when the receptacle is mounted on the top surface of the substrate. Further, the top earth pattern conductor is formed between the main portion of the hot-line terminal and the top surface of the substrate.

12 Claims, 8 Drawing Sheets

SURFACE MOUNT TYPE RECEPTACLE OF COAXIAL CONNECTOR AND MOUNTING ARRANGEMENT FOR MOUNTING RECEPTACLE OF COAXIAL CONNECTOR ON SUBSTRATE

BACKGROUND OF THE INVENTION

1. Field of the Invention

The present invention relates to a surface mount type receptacle of coaxial connector and a mounting arrangement for mounting a receptacle of a coaxial connector on a substrate, and in particular, to a surface mount type receptacle of coaxial connector and a mounting arrangement for mounting a surface mount type receptacle of a coaxial connector on a substrate which are capable of establishing a better reflection characteristic.

2. Description of the Related Art

FIG. 7 is a perspective view of a surface mount type receptacle 100*e* of a conventional coaxial connector, FIG. 8 is a plan view showing a structure of a bottom surface of the receptacle 100*e* of the conventional coaxial connector shown in FIG. 7 which opposes to a top surface of a substrate 57 shown in FIG. 9B, FIG. 9A is a front view of a plug 62 of the conventional coaxial connector shown in FIGS. 7 and 8, FIG. 9B is a cross-sectional view of the receptacle 100*e* of the conventional coaxial connector shown in FIG. 9A, FIG. 10A is a plan view of the substrate 57 on which the receptacle 100*e* of the conventional coaxial connector shown in FIGS. 9A and 9B, and FIG. 10B is a cross-sectional view of the substrate 57 along a XB–XB' line of FIG. 10A.

Referring to FIG. 10B, both of a transmission line conductor or hot-line pattern conductor 58 of a microwave transmission line such as a micro-strip line or the like and a top earth pattern conductor 59 are formed on a top surface of the substrate 57, whereas a bottom earth pattern conductor 60 is formed on all the area of the bottom surface of the substrate 57. In the specification, an electrical conductor is referred to as a conductor hereinafter.

Referring to FIGS. 7, 8 and 9B, the conventional receptacle 100*e* of the coaxial connector comprises:

(a) a rectangular-parallelepiped-shaped case 51 of an electrically insulating material such as a resin or the like;

(b) a cylindrical inner conductor 52 arranged in the center of a cylindrical concavity 51*a* formed in the case 51 so that the axis direction of the inner conductor 52 is perpendicular to the bottom surface of the case 51;

(c) a curved-plate-shaped or partial-cylinder-shaped outer conductor 53 formed on the inner surface of the concavity 51*a*;

(d) a hot-line terminal 54 electrically connected to the inner conductor 52, the hot-line terminal 54 being formed so as to horizontally penetrate the case 51 from the inner conductor 52 and be taken out or extend from the inner conductor 52 through the side surface of the case 51 to the bottom surface of the case 51; and (e) an earth terminal 55 electrically connected to the outer conductor 53, the earth terminal 55 being formed so as to be taken out or extend from the outer conductor 53, horizontally penetrating the case 51 and extending through the side surface of the case to the bottom surface thereof.

As shown in FIG. 9B, the receptacle 100*e* is mounted on the substrate 57 by respectively soldering the hot-line terminal 54 and the earth terminal 55 onto the hot-line pattern conductor 58 and the top earth pattern conductor 59 of the substrate 57 through solders 301 and 302. Thereafter, the plug 62 to which a coaxial cable has been attached 61 is inserted to the receptacle 100*e* so as to connected thereto, and then the hot-line pattern conductor 58 and the top earth pattern conductor 59 formed on the substrate 57 are electrically connected to a center conductor and an outer conductor (both not shown) of the coaxial cable 61, respectively.

In the above-mentioned conventional surface mount type receptacle 100*e* of the coaxial connector, the width W of the hot-line terminal 54 shown in FIG. 8 is set so that the reflection in the coaxial connector become the minimum when the substrate 57 is made of a dielectric material having a predetermined dielectric constant $\epsilon_r$ and the thickness of the substrate 57 is set to a predetermined value such as 1 mm.

In this case, when the thickness of the substrate 57 is changed or the material thereof is changed, the capacitance formed between the hot-line terminal 54 and the bottom earth pattern conductor 60 changes, and then the characteristic impedance of the coaxial connector changes. This leads to increase in the reflection, and deterioration in the electrical characteristic. In particular, recently, multi-layered substrates have been often used, and the thickness of each layer of the multi-layered substrate is small such as 0.2 to 0.3 mm. Therefore, the capacitance formed between the hot-line terminal 54 and the bottom earth pattern conductor 60 increases, and then the characteristic impedance is lowered, resulting in deterioration in the reflection characteristic.

SUMMARY OF THE INVENTION

An object of the present invention is therefore to provide a surface mount type receptacle of a coaxial connector capable of establishing an improved reflection characteristic even when the receptacle is mounted on a single-layered substrate having a small thickness or a multi-layered substrate comprising respective layers each layer having a small thickness.

Another object of the present invention is to provide a mounting arrangement of a surface mount type receptacle of a coaxial connector onto a substrate, capable of establishing an improved reflection characteristic even when the receptacle is mounted on a single-layered substrate having a small thickness or a multi-layered substrate comprising respective layers each layer having a small thickness.

In order to achieve the aforementioned objective, according to one aspect of the present invention, there is provided a surface mount type receptacle of a coaxial connector mounted on a substrate having a hot-line pattern conductor and a top earth pattern conductor formed on a top surface of said substrate, and a bottom earth pattern conductor formed on a bottom surface of said substrate, said receptacle comprising:

a case of an electrically insulating material having a top surface, side surfaces and a bottom surface to be mounted on the top surface of the substrate, said case having a concavity formed so as to extend from the top surface of said case toward the center of said case;

an inner conductor arranged in said concavity of said case;

an outer conductor arranged in said concavity of said case;

at least one hot-line terminal formed in said case so as to be electrically connected to said inner conductor and extend from said inner conductor through the side surface of said case to the bottom surface of said case; and an earth terminal formed in said case so as to be electrically connected to said outer conductor and extend from said outer conductor to the bottom surface of said case, said earth terminal having a main portion thereof provided in said case so as to oppose to the bottom surface of said case;

wherein said earth terminal is formed on the bottom surface of said case between the main portion of said hot-line terminal and the top surface of said substrate so as to decrease an area where said hot-line terminal opposes to said bottom earth pattern conductor when said receptacle is mounted on the top surface of said substrate.

In the above-mentioned receptacle, said earth terminal is preferably formed so as to extend from said outer conductor through the side surfaces of said case to the bottom surface of said case.

In the above-mentioned receptacle, said earth terminal is preferably formed in an area of the bottom surface of said case other than an area of said hot-line terminal on the bottom surface thereof so as to be electrically insulated from said hot-line terminal.

In the above-mentioned receptacle, at least one earth terminal piece electrically connected to said earth terminal is preferably formed so as to extend from said earth terminal through the center of the side of the bottom surface of said case, projecting onto the bottom surface of said case.

According to another aspect of the present invention, there is provided a mounting arrangement for arranging a surface mount type receptacle of a coaxial connector on a substrate having a hot-line pattern conductor and a top earth pattern conductor formed on a top surface of said substrate, and a bottom earth pattern conductor formed on a bottom surface of said substrate, wherein said receptacle comprises:

a case of an electrically insulating material having a top surface, side surfaces and a bottom surface to be mounted on the top surface of the substrate, said case having a concavity formed so as to extend from the top surface of said case toward the center of said case;

an inner conductor arranged in said concavity of said case;

an outer conductor arranged in said concavity of said case;

at least one hot-line terminal formed in said case so as to be electrically connected to said inner conductor and extend from said inner conductor through the side surface of said case to the bottom surface of said case; and an earth terminal formed in said case so as to be electrically connected to said outer conductor and extend from said outer conductor to the bottom surface of said case, said earth terminal having a main portion thereof provided in said case so as to oppose to the bottom surface of said case; and wherein the top earth pattern conductor is formed on the top surface of said substrate between the main portion of said hot-line terminal and the top surface of said substrate so as to decrease an area where said hot-line terminal opposes to said bottom earth pattern conductor when said receptacle is mounted on the top surface of said substrate.

In the above-mentioned mounting arrangement, said earth terminal is preferably formed on the bottom surface of the said case between the main portion of said hot-line terminal and the top surface of said substrate so as to decrease an area where said hot-line terminal opposes to said bottom earth pattern conductor when said receptacle is mounted on the top surface of said substrate.

In the above-mentioned mounting arrangement, said earth terminal is preferably formed so as to extend from said outer conductor through the side surfaces of said case to the bottom surface of said case.

In the above-mentioned mounting arrangement, said earth terminal is preferably formed in an area of the bottom surface of said case other than an area of said hot-line terminal on the bottom surface thereof so as to be electrically insulated from said hot-line terminal.

In the above-mentioned mounting arrangement, at least one earth terminal piece electrically connected to said earth terminal is preferably formed so as to extend from said earth terminal through the center of the side of the bottom surface of said case, projecting onto the bottom surface of said case.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

The preferred embodiments according to the present invention will be described below with reference to the attached drawings.

First Preferred Embodiment

Figure 1A:
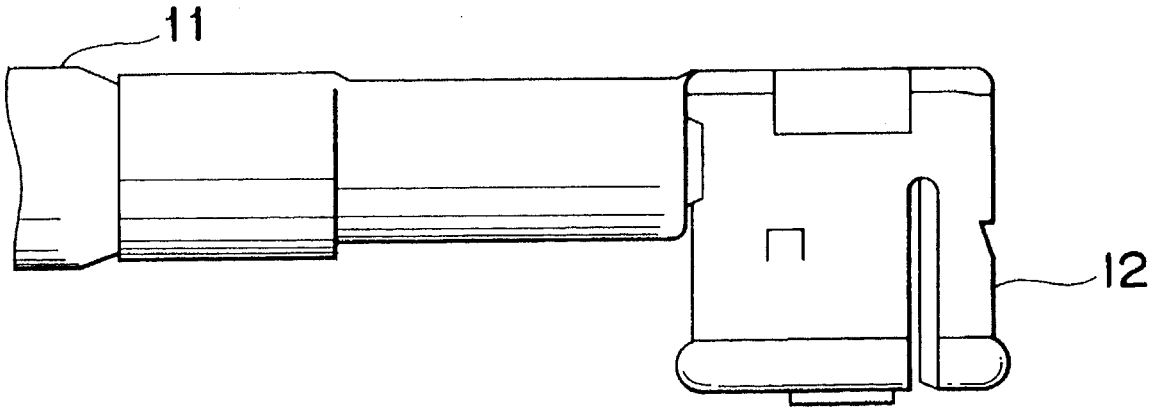
FIG. 1A is a front view of a plug of a coaxial connector according to the first preferred embodiment of the present invention.
Figure 1B:
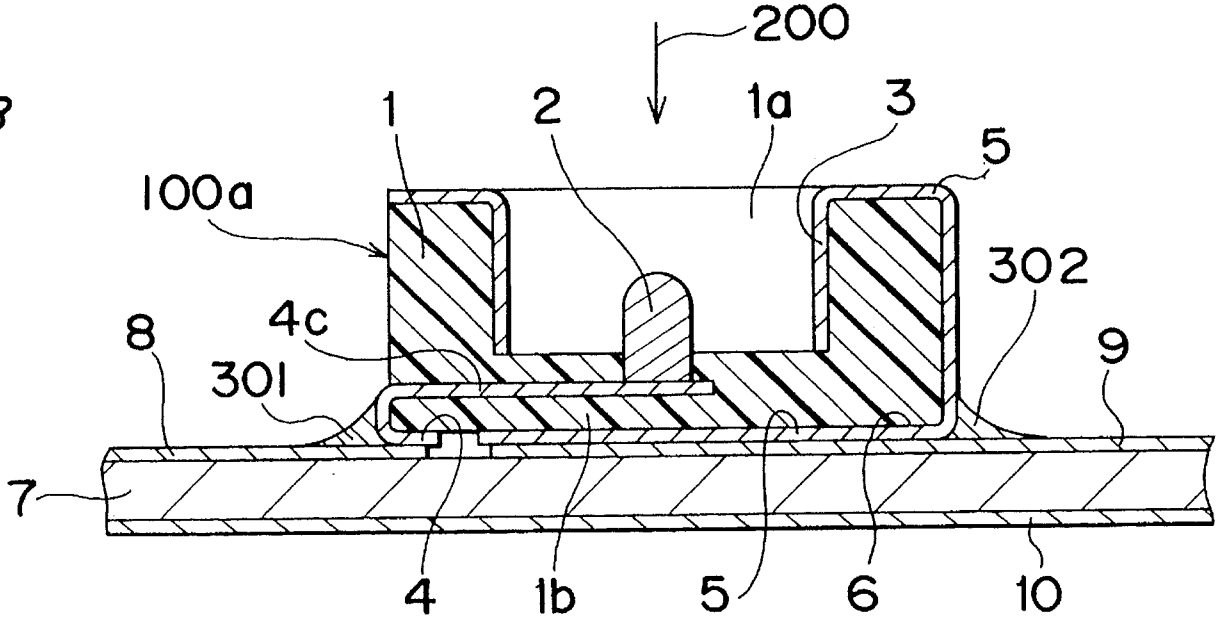
FIG. 1B is a cross-sectional view of a surface mount type receptacle of the coaxial connector connected to the plug shown in FIG. 1, which is mounted on a substrate.
Figure 2:
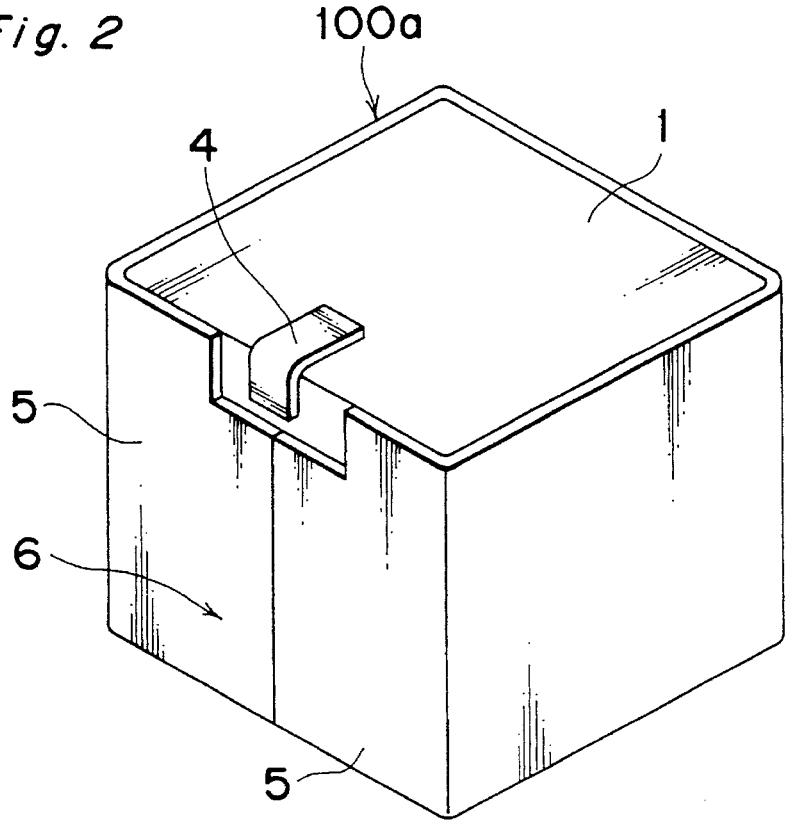
FIG. 2 is a perspective view showing a structure of a bottom surface of the receptacle opposing to a top surface of the substrate on which the receptacle is mounted.
Figure 3:
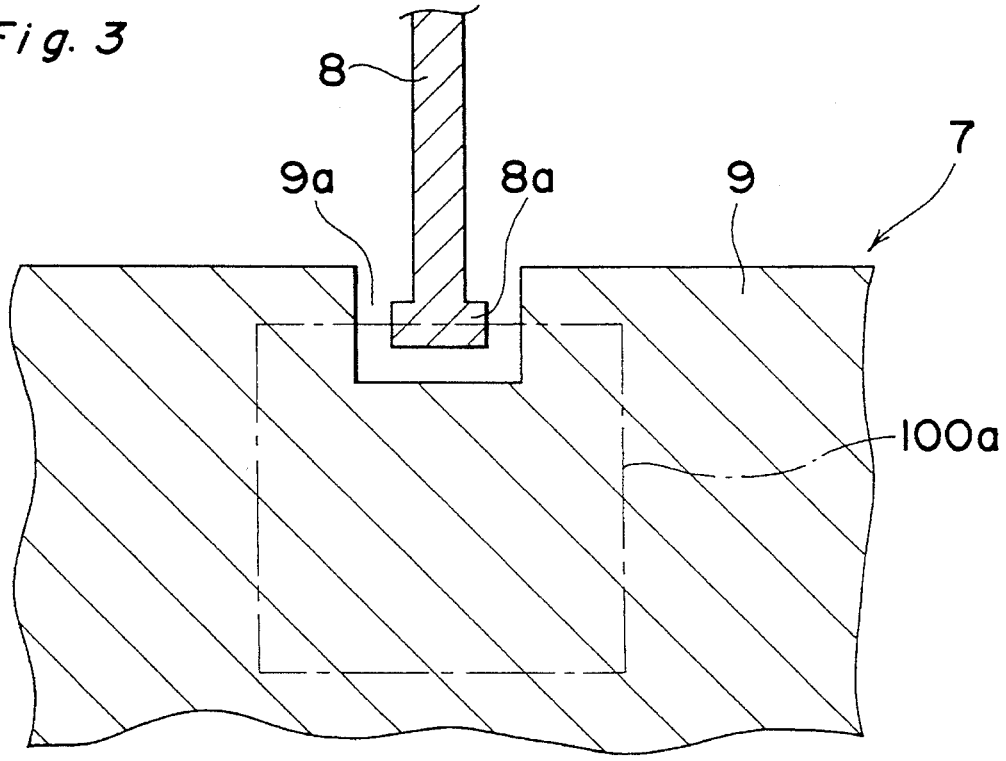
FIG. 3 is a plan view of a hot-line pattern conductor and a top earth pattern conductor which are formed on the top surface of the substrate used in the first preferred embodiment shown in FIGS. 1 and 2.

FIG. 1A is a front view of a plug 12 of a coaxial connector according to the first preferred embodiment of the present invention, FIG. 1B is a cross-sectional view of a surface mount type receptacle 100*a* of the coaxial connector connected to the plug shown in FIG. 1, which is mounted on a substrate 7, FIG. 2 is a perspective view showing a structure of a bottom surface 6 of the receptacle 100*a* opposing to a top surface of the substrate 7 on which the receptacle 100*a* is mounted, FIG. 3 is a plan view of a hot-line pattern conductor 8 and a top earth pattern conductor 9 which are formed on the top surface of the substrate 7 used in the first preferred embodiment shown in FIGS. 1 and 2.

Referring to FIGS. 1B, 2 and 3, the receptacle 100*a* of the coaxial connector according to the first preferred embodiment comprises:

(a) a rectangular-parallelepiped-shaped case 1 of an electrically insulating material such as a resin or the like, the case 1 having a top surface, four side surfaces and a bottom surface 6;

(b) a cylindrical inner conductor 2 arranged in the center of a cylindrical concavity 1*a* formed in the case 1 so as to extend from the top surface of the case 1 toward the center thereof and so that the axis direction of the inner conductor 2 is perpendicular to the bottom surface 6 of the case 1;

(c) a curved-plate-shaped or partial-cylinder-shaped outer conductor 3 formed on the inner surface of the concavity 1*a*;

(d) a hot-line terminal 4 electrically connected to the inner conductor 2, the hot-line terminal 4 being formed so as to horizontally penetrate the case 1 from the inner conductor 2 and be taken out or extend from the inner conductor 2 through the side surface of the case 1 and the center of the side of the bottom surface 6 thereof, projecting onto the bottom surface 6 thereof; and (e) an earth terminal 5 electrically connected to the outer conductor 3, the earth terminal 5 being formed so as to be taken out or extend from the outer conductor 3 through the top and all the four side surfaces of the case 1 to the bottom surface 6 thereof, fourth extending to a portion near the hot-line terminal 4.

In the receptacle 100*a* of the coaxial connector, the earth terminal 5 is formed so as to be taken out or extend from the top surface of the case 1 through all the four side surfaces to the bottom surface 6, to be electrically insulated from the hot-line terminal 4 and to cover a main portion of the bottom surface 6 of the case 1 which is almost all the area of the bottom surface 6 other than an area of and near the hot-line terminal 4, and further the hot-line terminal 4 is formed so that a portion of the hot-line terminal 4 is exposed from an area not covered by the earth terminal 5 formed on the bottom surface 6 of the case 1. Therefore, a main portion 4*c* of the hot-line terminal 4, which penetrates in the lower portion of the case 1 so as to oppose to the bottom surface 6 of the case 1 and is provided in the case 1 between the inner conductor 2 and the side surface or the bottom surface 6 of the case 1, is covered by the earth terminal 5 through an electrically insulating portion 1*b* located in the lower portion of the case 1, and then the earth terminal 5 is located between the main portion 4*c* of the hot-line terminal 4 and the substrate or printed circuit board 7 of a dielectric material on which the receptacle 100*a* is to be mounted.

Referring to FIGS. 1B and 3, a strip-shaped transmission line conductor or hot-line pattern conductor 8 of a microwave transmission line such as a micro-strip line or the like and a top earth pattern conductor 9 are formed on a top surface of the substrate 7, whereas a bottom earth pattern conductor 10 is formed on all the area of the bottom surface of the substrate 7.

Further, in the substrate 7, a cut portion 9*a* is formed in an end of the top earth pattern conductor 9 formed on the top surface of the substrate 7, and the hot-line pattern conductor 8 is formed so that an end 8*a* of the hot-line pattern conductor 8 extends into the cut-portion 9*a*. Furthermore, the top earth pattern conductor 9 formed on the top surface of the substrate 7 is formed so as to oppose to not only the main portion of the bottom surface 6 of the case 1 to be mounted on the top surface of the substrate 7 but also the earth terminal 6 formed on the bottom surface 6 thereof, and then the top earth pattern conductor 9 is formed between the earth terminal 5 formed on the bottom surface 6 thereof and the bottom earth pattern conductor 10 formed on the bottom surface of the substrate 7. This results in decrease in the area where the hot-line terminal 4 opposes to the bottom earth pattern conductor 10 when the receptacle 100*a* is mounted on the top surface of the substrate 7.

Thereafter, the receptacle 100*a* is arranged on a predetermined area on the substrate 7 which is indicated by an alternate long and short dash line of FIG. 3, and is mounted on this area by respectively soldering the hot-line terminal 4 and the earth terminal 5 onto the hot-line pattern conductor 8 and the top earth pattern conductor 9 of the substrate 7 through solders 301 and 302. Thereafter, the plug 12 to which a coaxial cable 11 has been attached is inserted to the receptacle 100*a* so as to connected thereto, and then the hot-line pattern conductor 8 and the bottom earth pattern conductor 10 formed on the substrate 57 are electrically connected to a center conductor and an outer conductor (both not shown) of the coaxial cable 11, respectively.

In the mounting arrangement of the receptacle 100*a* of the coaxial connector of the present preferred embodiment, the receptacle 100*a* of the coaxial connector is constituted so that the earth terminal 5 is provided between the main portion 4*c* of the hot-line terminal 4 and the substrate 7, and the top earth pattern conductor 9 formed on the top surface of the substrate 7 is formed so as to oppose to not only the main portion of the bottom surface 6 of the case 1 to be mounted on the top surface of the substrate 7 but also the earth terminal 6 formed on the bottom surface 6 thereof. Therefore, both of the earth terminal 5 and the top earth pattern conductor 9 formed on the top surface of the substrate 7 are arranged between the main portion of the hot-line terminal 4 and the bottom earth pattern conductor 10. This results in decrease in the capacitance from being formed between the hot-line terminal 4 and the bottom earth pattern conductor 10, and prevents the characteristic impedance of the receptacle 100*a* from being shifted from predetermined characteristic impedances of the coaxial cable 11 and the micro-strip line comprised of the strip-shaped transmission line conductor 8 and the bottom earth pattern conductor 10. Accordingly, this establishes an improved reflection characteristic in the receptacle 100*a* of the coaxial connector.

Further, FIGS. 4A and 4B, 5A and 5B, and 6A and 6B show the second to fourth preferred embodiments according to the present invention, and these preferred embodiments will be described hereinafter.

Second Preferred Embodiment

Figure 4A:
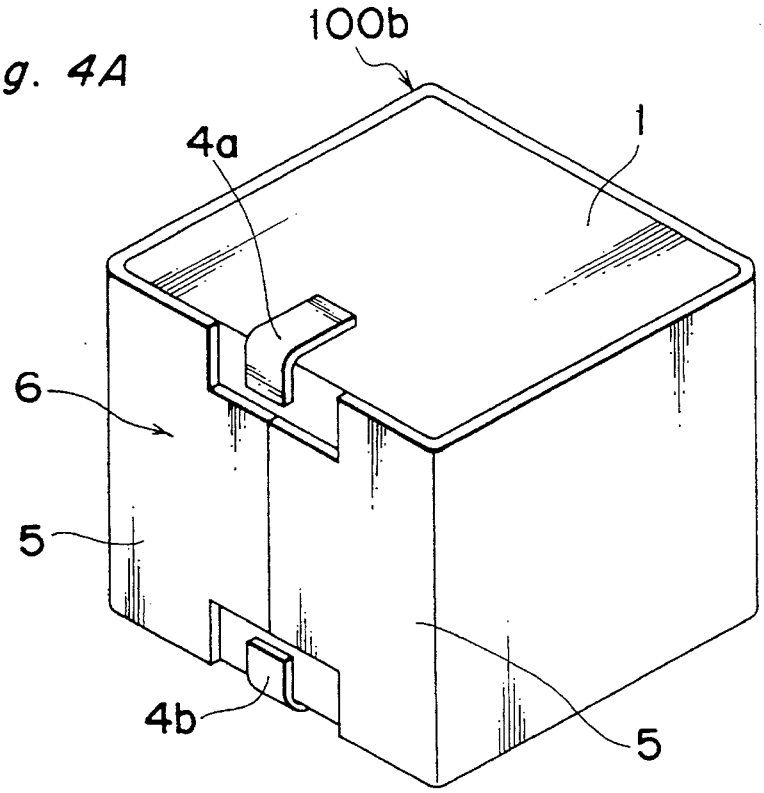
FIG. 4A is a perspective view showing a structure of a bottom surface of a surface mount type receptacle of a coaxial connector according to the second preferred embodiment of the present invention, which opposes to a top surface of a substrate.
Figure 4B:
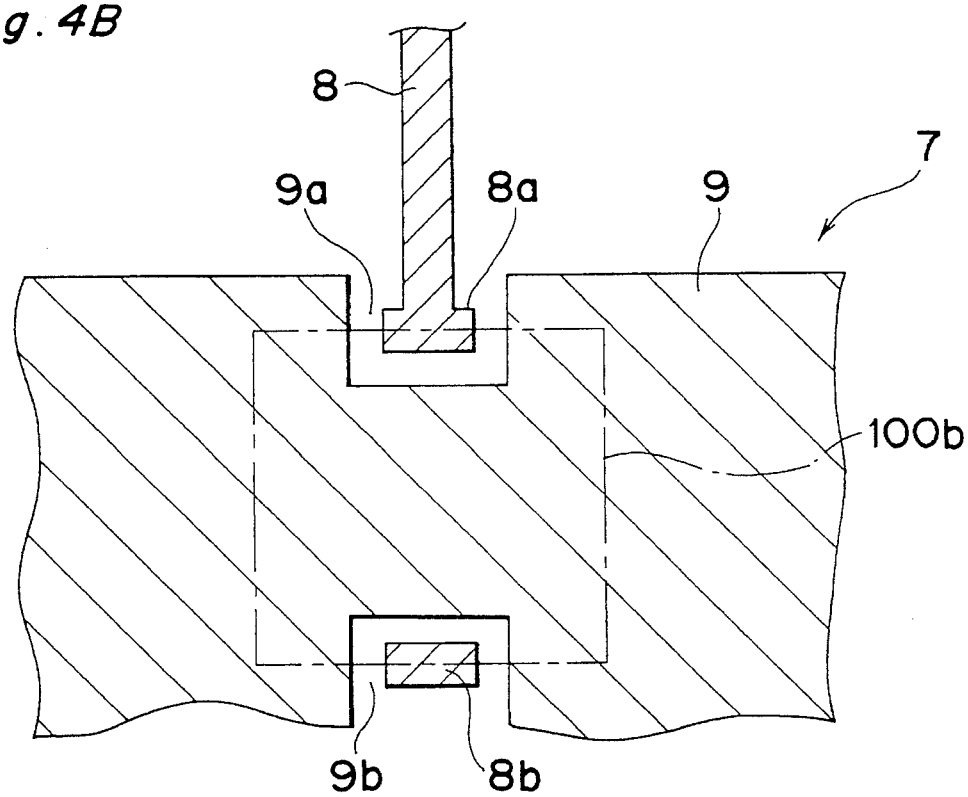
FIG. 4B is a plan view of a hot-line pattern conductor and a top earth pattern conductor which are formed on the top surface of the substrate used in the second preferred embodiment shown in FIG. 4A.

FIG. 4A is a perspective view showing a structure of a bottom surface 6 of a surface mount type receptacle 100*b* of a coaxial connector according to the second preferred embodiment of the present invention, which opposes to a top surface of a substrate 7, and FIG. 4B is a plan view of a hot-line pattern conductor 8 and a top earth pattern conductor 9 which are formed on the top surface of the substrate 7 used in the second preferred embodiment shown in FIG. 4A.

Referring to FIG. 4A, the receptacle 100*b* has such a structure that hot-line terminals 4*a* and 4*b* are formed respectively so as to be taken out or extend through the respective centers of the opposing two sides or ends of the bottom surface 6 of the case 1 projecting onto the bottom surface 6 thereof, and also the other area of the bottom surface 6, than the two areas where the hot-line terminals 4*a* and 4*b* is formed, is covered by the earth terminal 5 so that the earth terminal 5 is electrically insulated from the hot-line terminals 4*a* and 4*b*. Further, as shown in FIG. 4B, cut portions 9*a* and 9*b* are formed respectively in opposing two ends of the top earth pattern conductor 9 formed on the top surface of the substrate 7, and the hot-line pattern 8 is formed so that an end 8*a* thereof extends into the cut portion 9*a*. Furthermore, in the cut portion 9*b* of the top earth pattern conductor 9, a dummy electrode 8*b* is formed onto which either one of the hot-line terminals 4*a* and 4*b* is fixed so as to be electrically connected.

In this case, the top earth pattern conductor 9 formed on the top surface of the substrate 7 is formed so as to oppose to not only the main portion of the bottom surface 6 of the case 1 to be mounted on the top surface of the substrate 7 but also the earth terminal 6 formed on the bottom surface 6 thereof, and then the top earth pattern conductor 9 is formed between the earth terminal 5 formed on the bottom surface 6 thereof and the bottom earth pattern conductor 10 formed on the bottom surface of the substrate 7. This results in decrease in the area where the hot-line terminal 4 opposes to the bottom earth pattern conductor 10 when the receptacle 100*b* is mounted on the top surface of the substrate 7.

Therefore, the earth terminal 5 and the top earth pattern conductor 9 formed on the top surface of the substrate 7 are arranged between the main portion of the hot-line terminal 4 and the bottom earth pattern conductor 10. This results in decrease in the capacitance from being formed between the hot-line terminal 4 and the bottom earth pattern conductor 10, and prevents the characteristic impedance of the receptacle 100*b* from being shifted from predetermined characteristic impedances of the coaxial cable 11 and the micro-strip line the micro-strip line comprised of the strip-shaped transmission line conductor 8 and the bottom earth pattern conductor 10. Therefore, this establishes an improved reflection characteristic in the receptacle 100*b* of the coaxial connector.

Accordingly, the second preferred embodiment has effects similar to those of the first preferred embodiment.

Third Preferred Embodiment

Figure 5A:
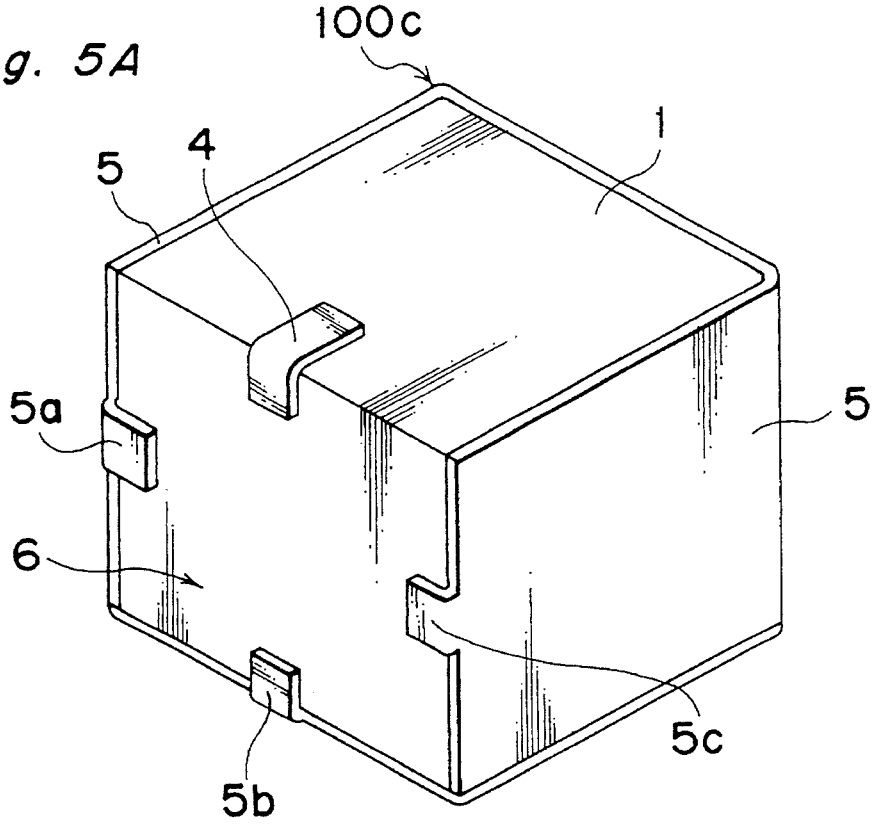
FIG. 5A is a perspective view showing a structure of a bottom surface of a surface mount type receptacle of a coaxial connector according to the third preferred embodiment of the present invention, which opposes to a top surface of a substrate.
Figure 5B:
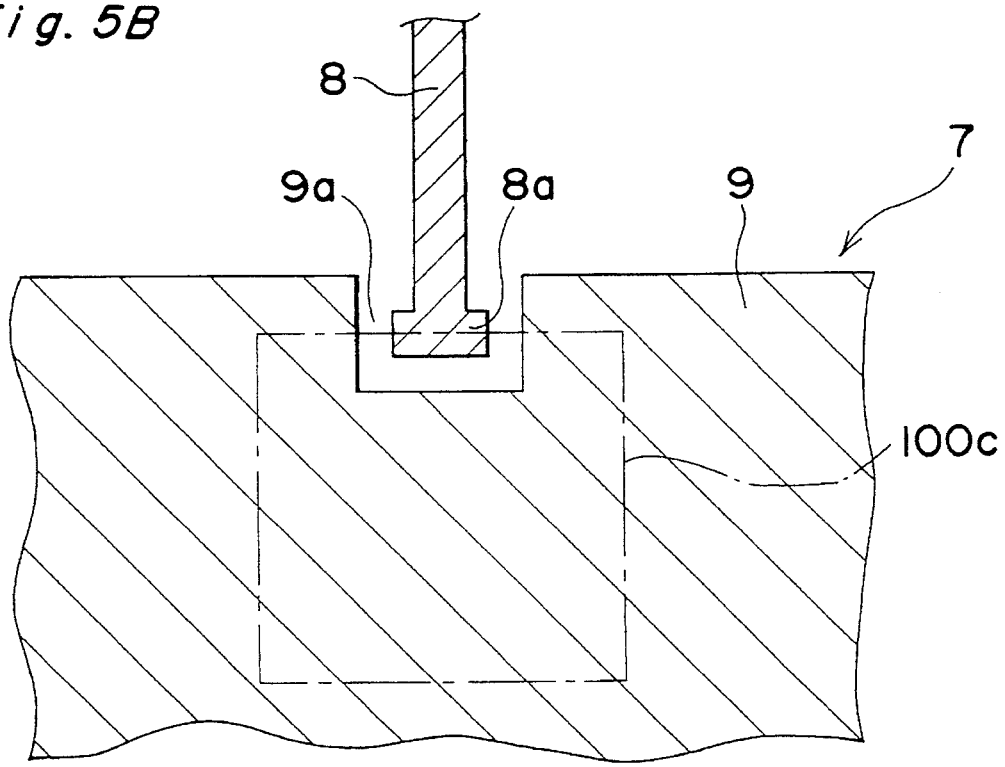
FIG. 5B is a plan view of a hot-line pattern conductor and a top earth pattern conductor which are formed on the top surface of the substrate used in the third preferred embodiment shown in FIG. 5A.

FIG. 5A is a perspective view showing a structure of a bottom surface 6 of a surface mount type receptacle 100*c* of a coaxial connector according to the third preferred embodiment of the present invention, which opposes to the top surface of the substrate 7, and FIG. 5B is a plan view of a hot-line pattern conductor 8 and a top earth pattern conductor 9 which are formed on the top surface of the substrate 7 used in the third preferred embodiment shown in FIG. 5A.

Referring to FIG. 5A, the receptacle 100*c* has such a structure that a hot-line terminal 4 is formed so as to be taken out or extend through the center of one side or end of the bottom surface 6 of the case 1 projecting onto the bottom surface 6 thereof, and earth terminal pieces 5*a*, 5*b* and 5*c* electrically connected to the earth terminal 5 are formed so as to be taken out or extend from the earth terminal 5 through the respective centers of the other three sides or ends of the bottom surface 6 of the case 1 projecting onto the bottom surface 6 thereof. Further, as shown in FIG. 5B, a cut portion 9*a* is formed in an end of the top earth pattern conductor 9 formed on the top surface of the substrate 7, and the hot-line pattern 8 is formed so that an end 8*a* thereof extends into the cut portion 9*a*.

In this case, the top earth pattern conductor 9 formed on the top surface of the substrate 7 is formed so as to oppose to the main portion of the bottom surface 6 of the case 1 to be mounted on the top surface of the substrate 7. Therefore, the top earth pattern conductor 9 formed on the top surface of the substrate 7 is arranged between the main portion of the hot-line terminal 4 and the bottom earth pattern conductor 10. This results in decrease in the capacitance from being formed between the hot-line terminal 4 and the bottom earth pattern conductor 10, and prevents the characteristic impedance of the receptacle 100*c* from being shifted from predetermined characteristic impedances of the coaxial cable 11 and the micro-strip line comprised of the strip-shaped transmission line conductor 8 and the bottom earth pattern conductor 10. Therefore, this establishes an improved reflection characteristic in the receptacle 100*c* of the coaxial connector.

Accordingly, the third preferred embodiment has effects similar to those of the first and second preferred embodiments.

Fourth Preferred Embodiment

Figure 6A:
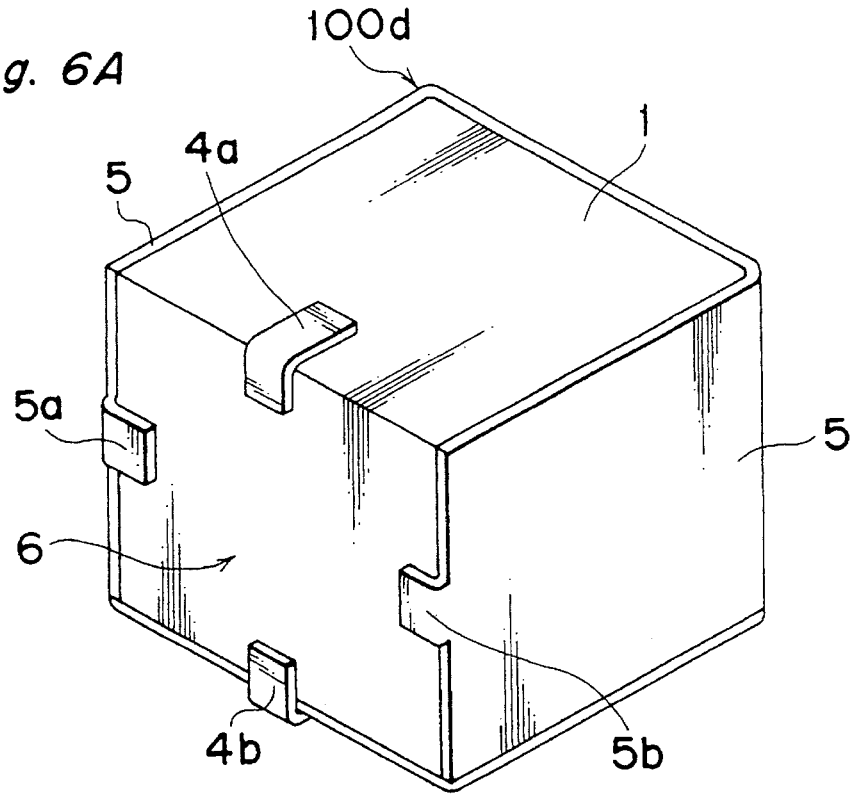
FIG. 6A is a perspective view showing a structure of a bottom surface of a surface mount type receptacle of a coaxial connector according to the fourth preferred embodiment of the present invention, which opposes to a top surface of a substrate.
Figure 6B:
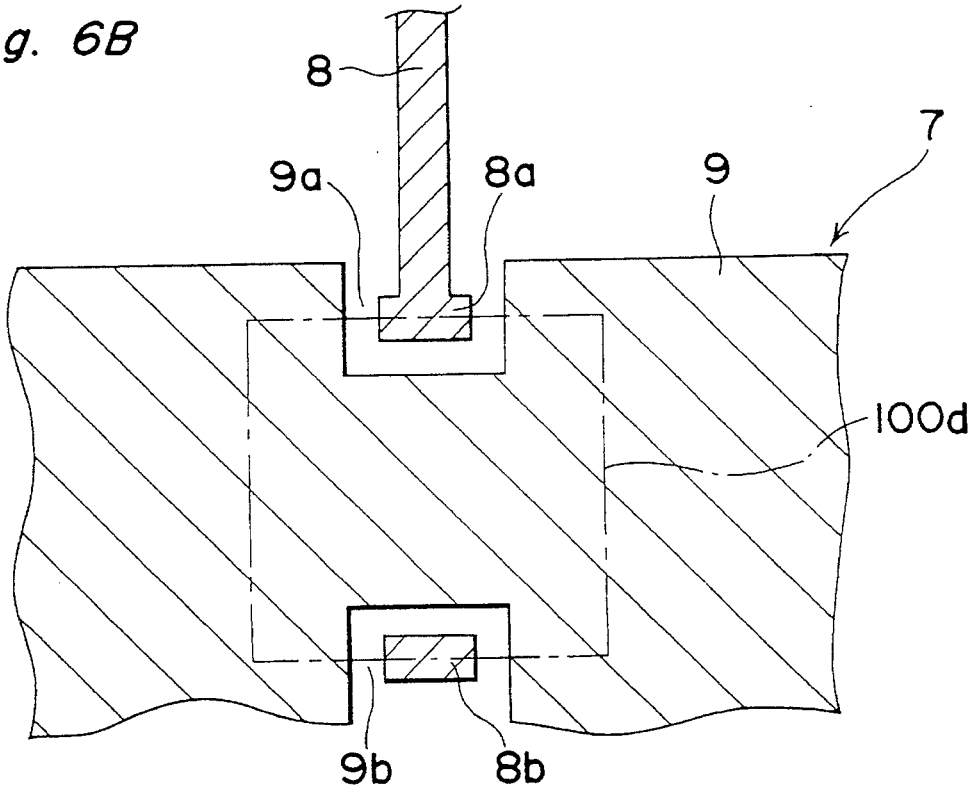
FIG. 6B is a plan view of a hot-line pattern conductor and a top earth pattern conductor which are formed on the top surface of the substrate used in the third preferred embodiment shown in FIG. 6A.
Figure 7:
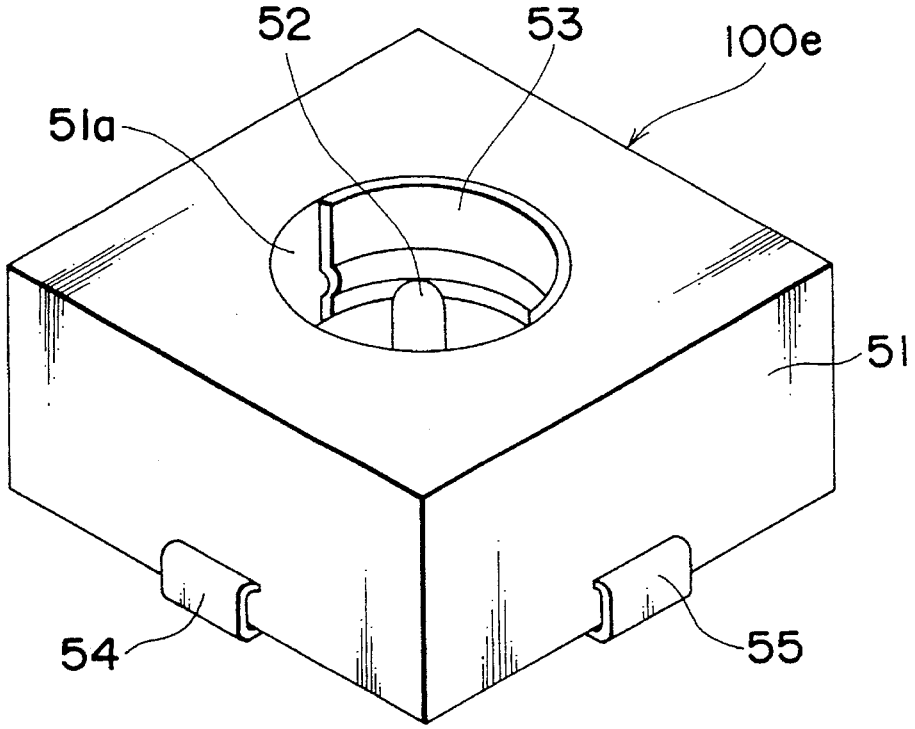
Fig. 7 PRIOR ART
FIG. 7 is a perspective view of a surface mount type receptacle of a conventional coaxial connector.
Figure 8:
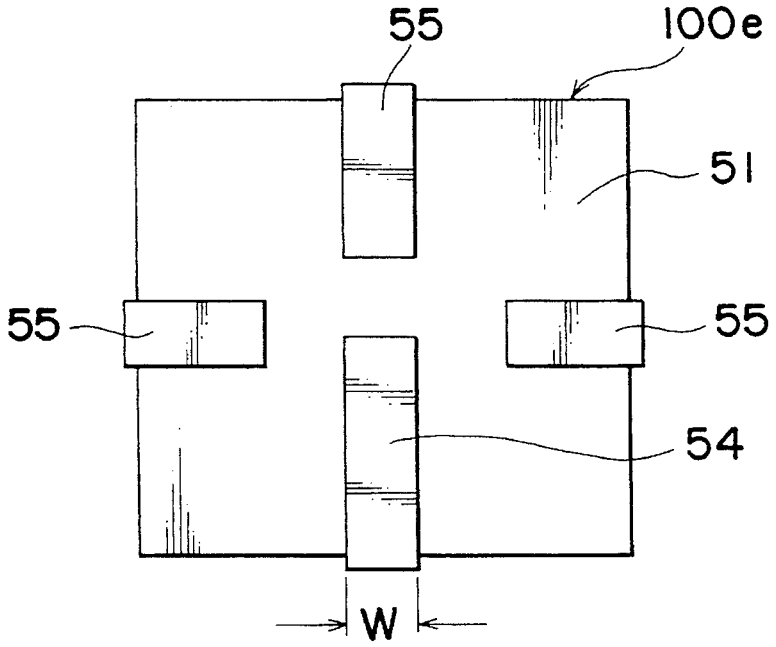
Fig. 8 PRIOR ART
FIG. 8 is a plan view showing a structure of a bottom surface of the receptacle of the conventional coaxial connector shown in FIG. 7, which opposes to a top surface of a substrate.
Figure 9A:
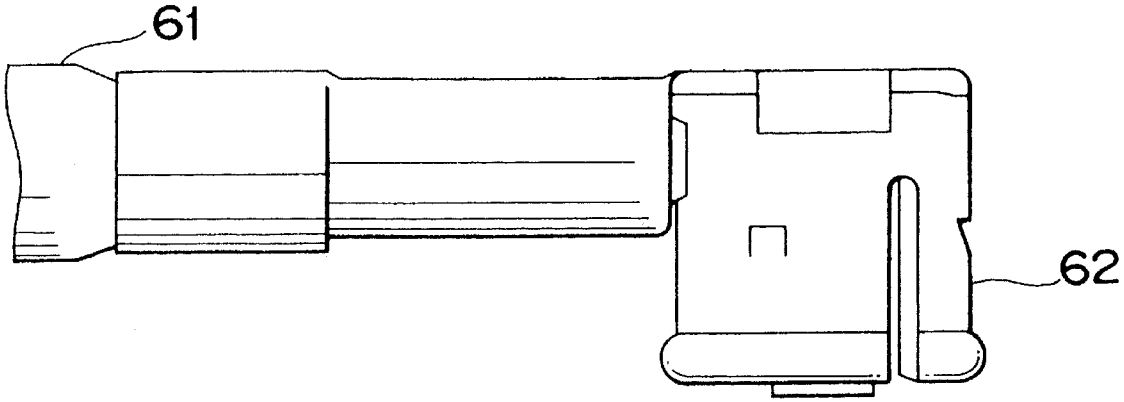
Fig. 9A PRIOR ART
FIG. 9A is a front view of a plug of the conventional coaxial connector shown in FIGS. 7 and 8.
Figure 9B:
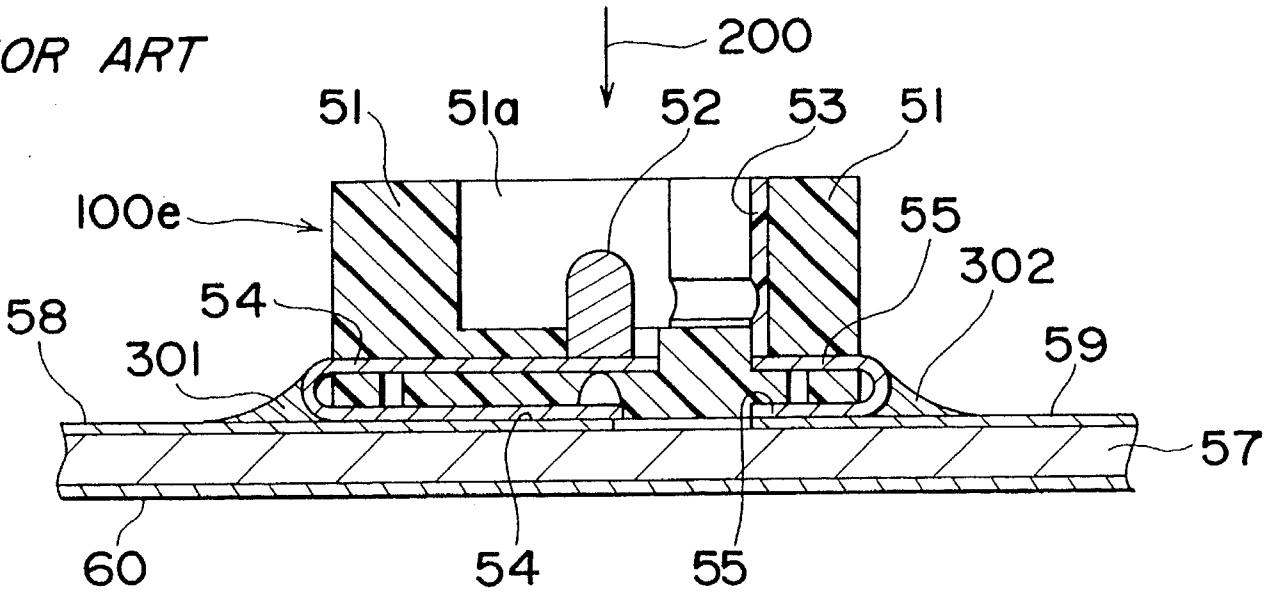
Fig. 9B PRIOR ART
FIG. 9B is a cross-sectional view of the receptacle of the conventional coaxial connector shown in FIG. 9A.
Figure 10A:
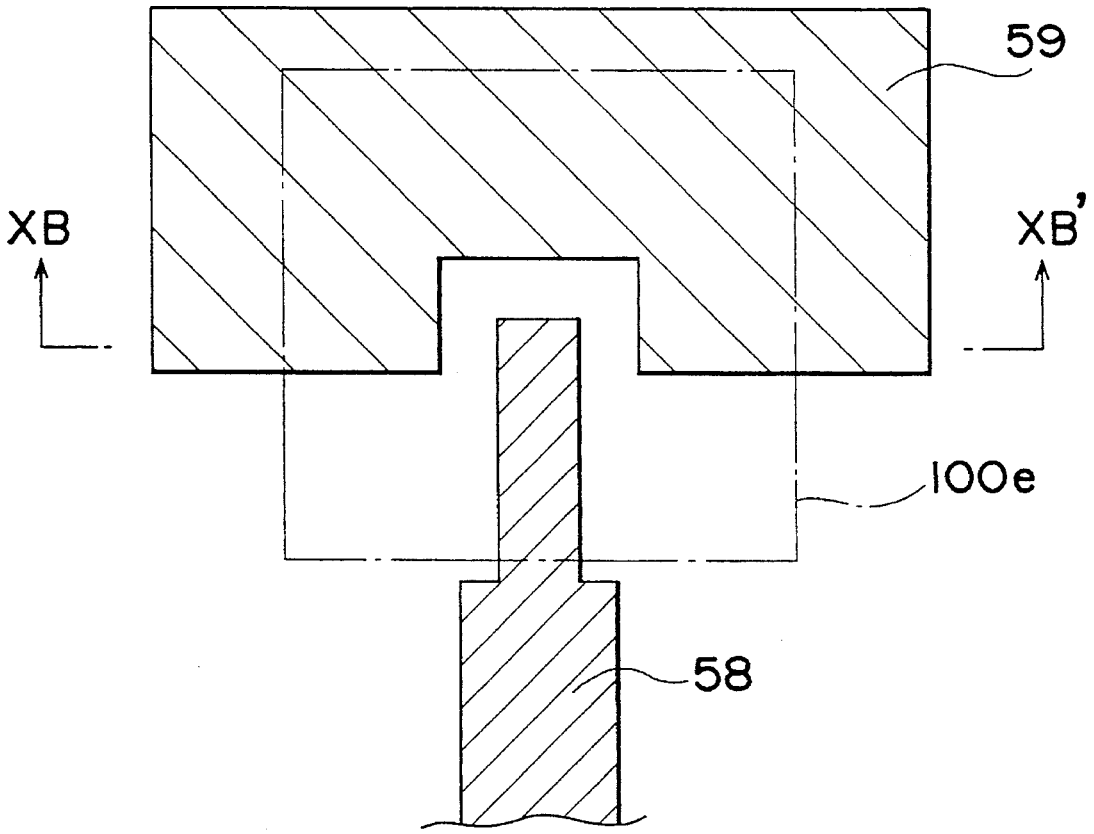
Fig. 10A PRIOR ART
FIG. 10A is a plan view of the substrate on which the receptacle of the conventional coaxial connector shown in FIGS. 9A and 9B.
Figure 10B:
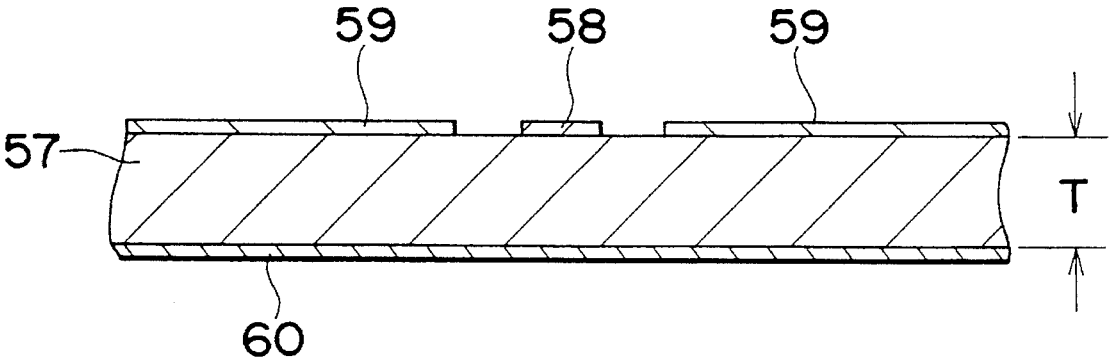
Fig. 10B PRIOR ART
FIG. 10B is a cross-sectional view of the substrate along a XB–XB' line of FIG. 10A.

FIG. 6A is a perspective view showing a structure of a bottom surface 6 of a surface mount type receptacle 100*d* of a coaxial connector according to the fourth preferred embodiment of the present invention, which opposes to the top surface of the substrate 7, and FIG. 6B is a plan view of a hot-line pattern conductor 8 and a top earth pattern conductor 9 which are formed on the top surface of the substrate 7 used in the third preferred embodiment shown in FIG. 6A.

Referring to FIG. 6A, the receptacle 100*c* has such a structure that hot-line terminals 4*a* and 4*b* are formed so as to be taken out or extend through the respective centers of opposing two sides or ends of the bottom surface 6 of the case 1, projecting onto the bottom surface 6 thereof, and earth terminal pieces 5*a* and 5*b* electrically connected to the earth terminal 5 are formed so as to be taken out or extend from the earth terminal 5 through the respective centers of the other two sides or ends of the bottom surface 6 of the case 1, projecting onto the bottom surface 6 thereof. Further, as shown in FIG. 6B, cut portions 9*a* and 9*b* are formed in opposing two ends of the top earth pattern conductor 9 formed on the top surface of the substrate 7, respectively, and the hot-line pattern 8 is formed so that an end 8*a* thereof extends into the cut portion 9*a*. Furthermore, in the cut-portion 9*b* of the top earth pattern conductor 9, a dummy electrode 8*b* is formed onto which either one of the hot-line terminals 4*a* and 4*b* is fixed so as to electrically connected.

In this case, the top earth pattern conductor 9 formed on the top surface of the substrate 7 is formed so as to oppose to the main portion of the bottom surface 6 of the case 1 to be mounted on the top surface of the substrate 7. Therefore, the top earth pattern conductor 9 formed on the top surface of the substrate 7 is arranged between the main portion of the hot-line terminal 4 and the bottom earth pattern conductor 10. This results in decrease in the capacitance from being formed between the hot-line terminal 4 and the bottom earth pattern conductor 10, and prevents the characteristic impedance of the receptacle 100*d* from being shifted from predetermined characteristic impedances of the coaxial cable 11 and the micro-strip line comprised of the strip-shaped transmission line conductor 8 and the bottom earth pattern conductor 10. Therefore, this establishes an improved reflection characteristic in the receptacle 100*d* of the coaxial connector.

Accordingly, the fourth preferred embodiment has effects similar to those of the first to third preferred embodiments.

The present invention is not limited to the above-mentioned preferred embodiments, and the followings can be changed within the scope of the claims attached herewith:

(a) shapes, the numbers, and the arranged positions of the hot-line terminal 4, 4*a* and 4*b*, the earth terminal 5, and the earth terminal pieces 5*a*, 5*b* and 5*c*; and (b) shapes of the hot-line pattern conductor 8 and the top earth pattern conductor 9; and (c) a material of the substrate 7.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A surface mount type receptacle of a coaxial connector mounted on a substrate having a hot-line pattern conductor and a top earth pattern conductor formed on a top surface of said substrate, and a bottom earth pattern conductor formed on a bottom surface of said substrate, said receptacle comprising:

a case of an electrically insulating material having a top surface, side surfaces and a bottom surface to be mounted on the top surface of the substrate, said case having a concavity formed so as to extend from the top surface of said case toward a center of said case;

an inner conductor arranged in said concavity of said case;

an outer conductor arranged in said concavity of said case;

at least one hot-line terminal formed in said case so as to be electrically connected to said inner conductor and extend from said inner conductor through the side surface of said case to the bottom surface of said case; and an earth terminal formed in said case so as to be electrically connected to said outer conductor and extend from said outer conductor to the bottom surface of said case, said earth terminal having a main portion thereof provided in said case so as to oppose to the bottom surface of said case;

wherein said earth terminal is formed on the bottom surface of said case between a main portion of said hot-line terminal and the top surface of said substrate so as to decrease an area where said hot-line terminal opposes to said bottom earth pattern conductor when said receptacle is mounted on the top surface of said substrate.

2. The receptacle as claimed in claim 1, wherein said earth terminal is formed so as to extend from said outer conductor through the side surfaces of said case to the bottom surface of said case.

3. The receptacle as claimed in claim 2, wherein said earth terminal is formed in an area of the bottom surface of said case other than an area of said hot-line terminal on the bottom surface thereof so as to be electrically insulated from said hot-line terminal.

4. The receptacle as claimed in claim 2, wherein at least one earth terminal piece electrically connected to said earth terminal is formed so as to extend from said earth terminal through a center of a side of the bottom surface of said case, projecting onto the bottom surface of said case.

5. A mounting arrangement for arranging a surface mount type receptacle of a coaxial connector on a substrate having a hot-line pattern conductor and a top earth pattern conductor formed on a top surface of said substrate, and a bottom earth pattern conductor formed on a bottom surface of said substrate, wherein said receptacle comprises:

a case of an electrically insulating material having a top surface, side surfaces and a bottom surface to be mounted on the top surface of the substrate, said case having a concavity formed so as to extend from the top surface of said case toward a center of said case;

an inner conductor arranged in said concavity of said case;

an outer conductor arranged in said concavity of said case;

at least one hot-line terminal formed in said case so as to be electrically connected to said inner conductor and extend from said inner conductor through the side surface of said case to the bottom surface of said case; and an earth terminal formed in said case so as to be electrically connected to said outer conductor and extend from said outer conductor to the bottom surface of said case, said earth terminal having a main portion thereof provided in said case so as to oppose to the bottom surface of said case; and wherein the top earth pattern conductor is formed on the top surface of said substrate between a main portion of said hot-line terminal and the top surface of said substrate so as to decrease an area where said hot-line terminal opposes to said bottom earth pattern conductor when said receptacle is mounted on the top surface of said substrate.

6. The mounting arrangement as claimed in claim 5, wherein said earth terminal is formed on the bottom surface of the said case between the main portion of said hot-line terminal and the top surface of said substrate so as to decrease an area where said hot-line terminal opposes to said bottom earth pattern conductor when said receptacle is mounted on the top surface of said substrate.

7. The mounting arrangement as claimed in claim 5, wherein said earth terminal is formed so as to extend from said outer conductor through the side surfaces of said case to the bottom surface of said case.

8. The mounting arrangement as claimed in claim 5, wherein said earth terminal is formed in an area of the bottom surface of said case other than an area of said hot-line terminal on the bottom surface thereof so as to be electrically insulated from said hot-line terminal.

9. The mounting arrangement as claimed in claim 5, wherein at least one earth terminal piece electrically connected to said earth terminal is formed so as to extend from said earth terminal through a center of a side of the bottom surface of said case, projecting onto the bottom surface of said case.

10. The mounting arrangement as claimed in claim 6, wherein said earth terminal is formed so as to extend from said outer conductor through the side surfaces of said case to the bottom surface of said case.

11. The mounting arrangement as claimed in claim 6, wherein said earth terminal is formed in an area of the bottom surface of said case other than an area of said hot-line terminal on the bottom surface thereof so as to be electrically insulated from said hot-line terminal.

12. The mounting arrangement as claimed in claim 6, wherein at least one earth terminal piece electrically connected to said earth terminal is formed so as to extend from said earth terminal through the center of the side of the bottom surface of said case, projecting onto the bottom surface of said case.

* * * * *